US005836294A

United States Patent [19]

Merritt

[11] Patent Number: 5,836,294

[45] Date of Patent: Nov. 17, 1998

[54] BOW SIGHT

[75] Inventor: James E. Merritt, 5217 Rule Rd., Bellville, Ohio 44813

[73] Assignees: James E. Merritt; Larry J. Caudill; Dwight W. Etzwiler, all of Bellville, Ohio

[21] Appl. No.: 856,295

[22] Filed: May 14, 1997

[51] Int. Cl.[6] ..... F41G 1/467

[52] U.S. Cl. ..... 124/87; 33/265

[58] Field of Search ..... 124/87; 33/265

[56] References Cited

U.S. PATENT DOCUMENTS

| | | | |
|---|---|---|---|
| 2,998,652 | 9/1961 | Zielinski | 33/265 |
| 4,473,959 | 10/1984 | Saltzman | 33/265 |
| 4,481,717 | 11/1984 | Kowalski | 33/265 |
| 4,638,565 | 1/1987 | Podany et al. | 33/265 |
| 5,121,547 | 6/1992 | Littlejohn | 33/265 |
| 5,253,423 | 10/1993 | Sullivan et al. | 33/265 |
| 5,255,440 | 10/1993 | Rogers | 33/265 |
| 5,303,479 | 4/1994 | Rudovsky | 33/265 |
| 5,464,003 | 11/1995 | Sherman | 124/87 |
| 5,634,278 | 6/1997 | London | 33/265 X |

OTHER PUBLICATIONS

Advertisements from Cabela's 1994 Catalog, p. 252.

Advertisements from Gander Mountain's 1995 Catalog, Archery Section, pp. 44–49 and 52–54.

Advertisements from Pro Bass Archery's 1996 Catalog, pp. 23–27 and 57.

Advertisements from John Morris Read Head's 1997 Catalog, pp. 188–190.

*Primary Examiner*—John A. Ricci

*Attorney, Agent, or Firm*—Sand & Sebolt

[57] ABSTRACT

A bow sight (10) includes a transparent rear sight plate (12) that is adjustably carried by a slide bar (14). A slide bar (14) is mounted to a bow (16) by a receiving bracket (18). The bow sight (10) further includes at least one sight dot (22) that is clamped between a transparent front sight plate (20) and the transparent rear sight plate (12) such that each sight dot (22) is surrounded by a transparent, unobstructed viewing area. A gasket (30) is disposed about the periphery of the front sight plate (20) such that the area interior to the gasket (30) is substantially sealed when the front sight plate (20) is clamping the sight dots (22) against the rear sight plate (12). The front sight plate (20) is connected to the rear sight plate (12) by a plurality of screws (24). An adjustment tool (50) is also provided that allows an archer to adjust the location of the sight dots (22) without completely removing the screws (24).

26 Claims, 2 Drawing Sheets

BOW SIGHT

TECHNICAL FIELD

This invention relates to sighting devices for archery bows. More particularly, the present invention relates to a sighting device for an archery bow having at least one sight dot disposed on a transparent sight plate such that the area surrounding the sight dot is unobstructed. Specifically, the present invention relates to a sighting device for an archery bow having a pair of transparent sight plates with at least one sight dot clamped between the plates such that the area surrounding the sight dot is unobstructed by opaque supports.

BACKGROUND OF THE INVENTION

Typical sighting devices for archery bows employ a plurality of sight dots that are each carried at the end of a support pin. The pins are, in turn, adjustably carried by a frame that is mounted to the bow. The pins are disposed such that the dots or the ends of the pins are aligned with the archer's field of vision. The dots or ends of pins are adjusted by the archer to correspond with different target distances. When an arrow is shot from a bow, the arrow travels in a curved flight path due to gravity. Thus, the longer the shot, the higher the archer must aim to compensate for the flight path. As such, the dots or ends of pins are typically vertically disposed such that when they are aligned with the target the arrow is pointed above the target. The dots are usually aligned and spaced to correspond to different desired known target distances such as 25 yards, 50 yards, 75 yards, and 100 yards.

However, when an archer uses a powerful bow, such as a modern compound bow, the sight dots are positioned relatively close together to correspond with the increased velocity of the arrow. When the bow sight is thus configured, the pins are close together and obstruct a substantial portion of the archer's field of vision. It is thus desirable to provide a sighting device that includes sight dots in a view field that is substantially unobstructed.

An unobstructed view field is particularly important in the environment where an archer typically hunts game. Such environments may be cluttered with foliage and other matter. In addition, the hunt may occur during the early morning hours in relatively low light conditions. Furthermore, a hunter may have to concentrate on a particular area for a long period of time before shooting. Thus, it is highly desirable to provide a sight for a bow with sight dots that are substantially unobstructed by opaque supports.

Another typical prior art sight that does not include opaque support pins is a sight that uses horizontal and vertical wires to form a cross hair. Although these wires present less of an obstruction than the pins, they still present aiming points that are not surrounded by a clear viewing area. In addition, the horizontal and vertical wires present unnecessary obstructions on which one may focus and draw one's attention away from the target.

It is thus desirable to provide a sighting device for a bow that includes sighting dots that are "floating" in a substantially transparent sight plate such that the area surrounding each dot is unobstructed.

SUMMARY OF INVENTION

In view of the foregoing, an aspect of the present invention is to provide a bow sight for a bow.

Another aspect of the present invention is to provide a bow sight that presents at least one sight dot that is floating in a substantially transparent viewing area.

Still another aspect of the present invention is to provide a bow sight, as above, that includes adjustable sight dots.

A further aspect of the present invention is to provide a bow sight, as above, that may be easily and adjustably mounted to a wide variety of bows.

Yet another aspect of the present invention is to provide a bow sight, as above, that does not easily fog up.

A further aspect of the present invention is to provide a bow sight, as above, that includes a sight plate that is vertically adjustable with respect to the bow.

These and other aspects of the invention will become apparent to those skilled in the art in light of the following disclosure and accompanying drawings.

A bow sight according to the present invention includes a support, a substantially transparent sight plate carried by the support, and at least one sight dot carried by the sight plate such that the sight dot is surrounded by an unobstructed viewing area.

The present invention is also directed to a bow sight including a support; a first substantially transparent sight plate carried by the support; a second substantially transparent sight plate carried by the first sight plate; and at least one sight dot clamped between the first and second sight plates such that the sight dot is surrounded by an unobstructed viewing area.

To acquaint persons skilled in the arts most closely related to the present invention, one preferred embodiment of a bow sight that illustrates a best mode now contemplated for putting the invention into practice is described herein by, and with reference to, the annexed drawings that form a part of the specification. The exemplary bow sight is described in detail without attempting to show all of the various forms and modifications in which the invention might be embodied. As such, the embodiment shown and described herein is illustrative, and as will become apparent to those skilled in these arts can be modified in numerous ways within the spirit and scope of the invention; the invention being measured by the appended claims and not by the details of the specification.

PREFERRED EMBODIMENT FOR CARRYING OUT THE INVENTION

Figure 2:
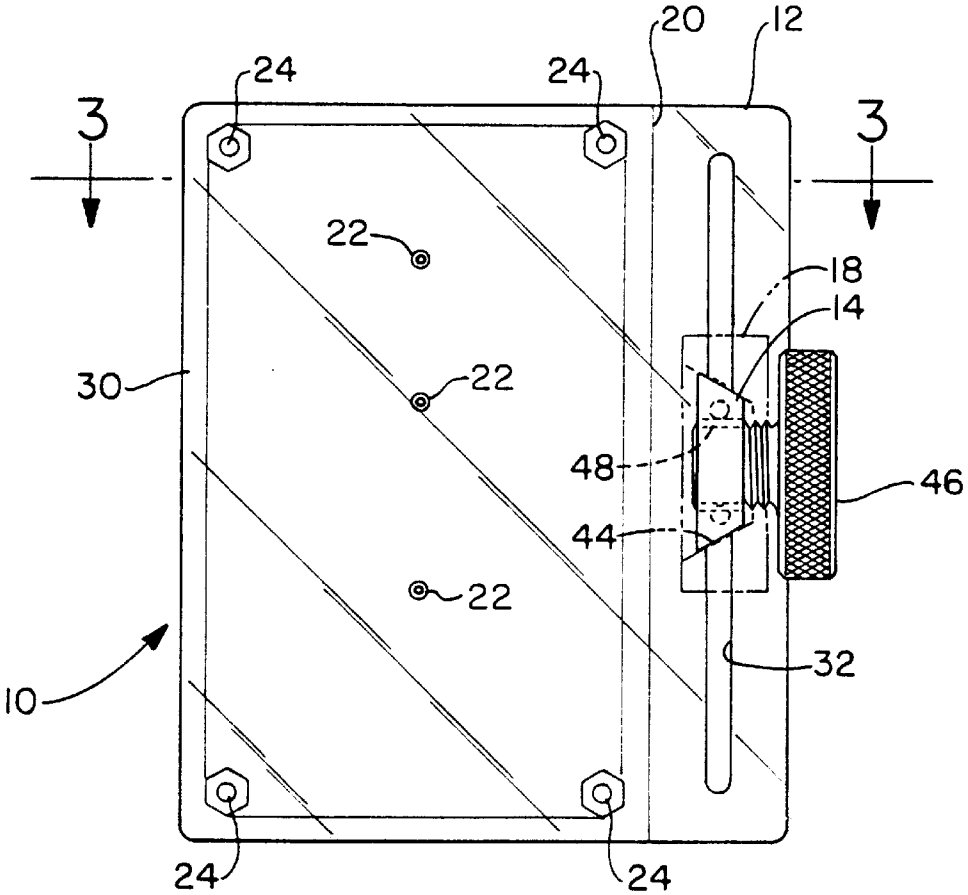
FIG. 2 is a front view of the bow sight.
Figure 1:
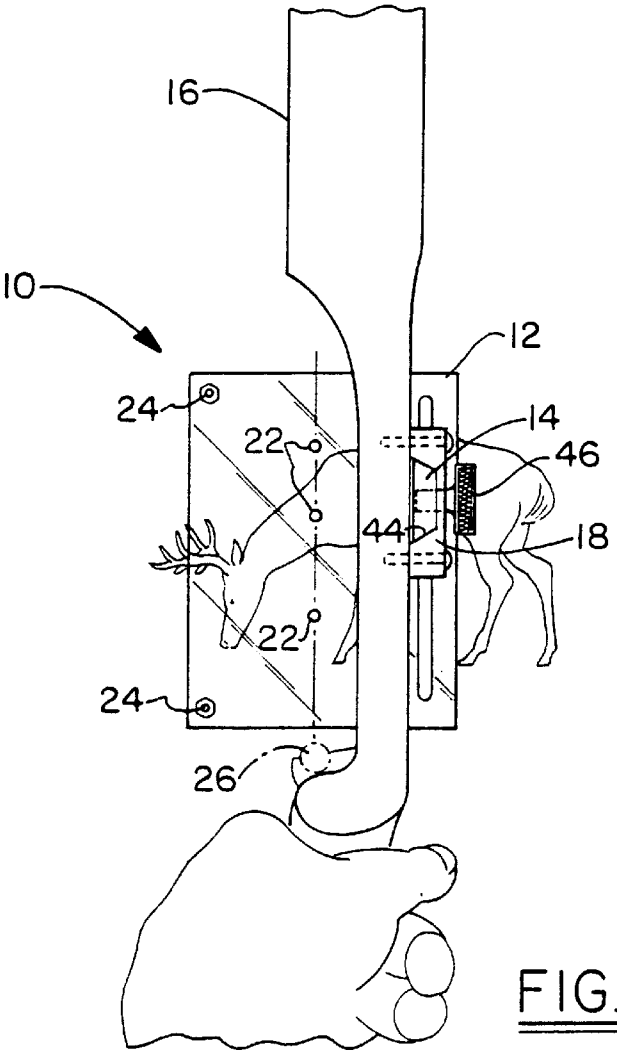
FIG. 1 is a view of a bow sight according to the present invention as seen by an archer when the bow sight is mounted to a bow.

A bow sight according to the concepts of the present invention is indicated generally by the numeral 10 in the accompanying drawings. The bow sight 10 generally includes a transparent rear sight plate 12 that is carried by a support in the nature of a wedge-shaped slide bar 14. The slide bar 14 is carried by the bow 16 in a receiving bracket 18 fixed to the bow 16.

A transparent front sight plate 20 clamps at least one sight dot 22 between itself and the rear sight plate 12. As may be seen in the drawings, additional sight dots 22 may be added and clamped between the plates 12, 20 to provide more than one aiming point to the archer. The front sight plate 20 may be adjustably clamped to the rear sight plate 12 by any of the various methods known in the art. In the preferred embodiment, the front sight plate 20 is connected to the rear sight plate 12 by four screws 24 that are disposed in the corners of the front sight plate 20. The screws 24 threadedly engage the rear sight plate 12 such that a clamping force may be created between the plates 12, 20 by tightening the screws 24. However, methods and devices other than screws 24 may be used to create the clamping force. As such, exterior clamps or a nut and bolt combination may be used to clamp the plates 12, 20 together. In other embodiments, the plates 12, 20 may be bonded together with a suitable adhesive.

Figure 3:
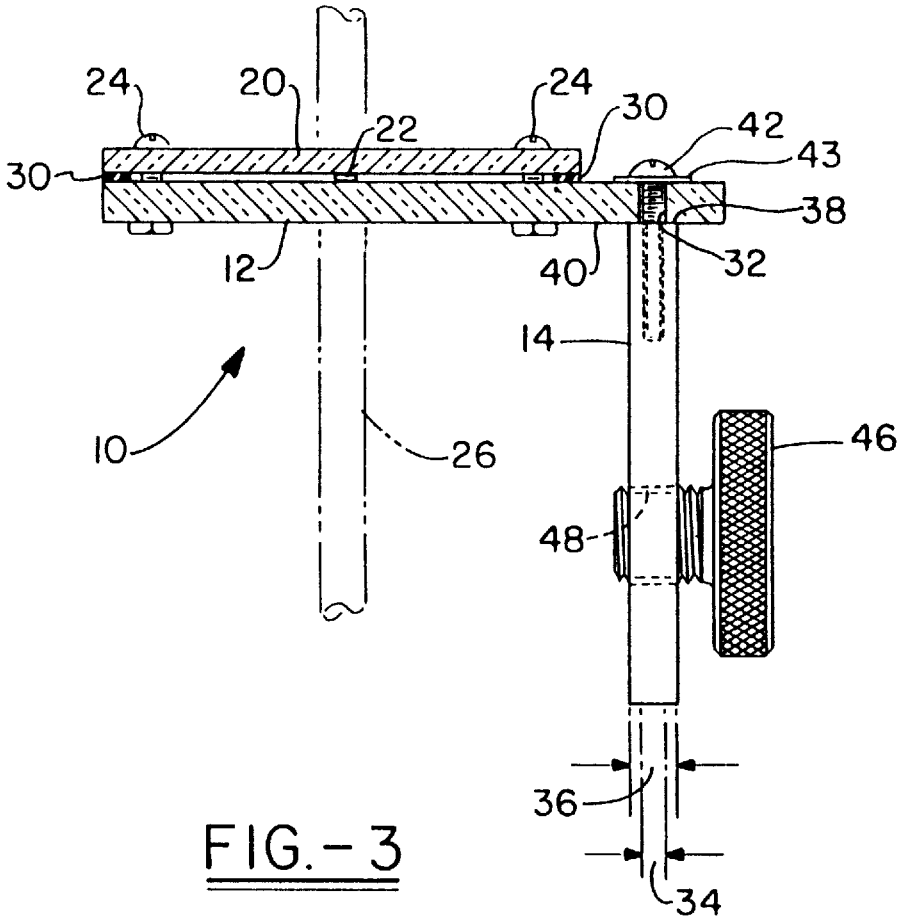
FIG. 3 is a top sectional view taken substantially along line 3—3 of FIG. 2.

The sight dots 22 may be substantially opaque or may be hollow. The sight dots 22 are clamped between the plates 12, 20. Each sight dot 22 has a thickness that may be approximately equal to half the thickness of the sight plates 12, 20. In the preferred embodiment of the present invention, the sight dots are approximately ⅛ of an inch thick. The sight dots 22 may be fabricated from plastic stock such that they may be easily clamped between the sight plates 12, 20 but will not scratch the sight plates 12, 20. The sight plates 12, 20 may be fabricated from any substantially transparent material such as plexiglass or glass. In the preferred embodiment of the present invention, the plates 12, 20 may be clear and fabricated from plexiglass, but in other embodiments of the present invention, the plates 12, 20 may be tinted. In yet other embodiments of the present invention, the plates 12, 20 may be polarized. As may be seen in FIG. 3, it is generally desirable to align the sight dots 22 with the arrow 26. Of course, the exact position of the sight dots 22 in the bow sight 10 will depend upon the preferences of the archer.

A gasket 30 is disposed about the periphery of the front sight plate 20. The gasket 30 is configured to substantially seal the area interior to the gasket 30 such that moisture does not penetrate the area to create condensation. The gasket 30 is flexible and crushable such that it maintains a substantial seal without interfering with the clamping force of the plates 12, 20 on the sight dot 22. The gasket 30 may be opaque, but it is preferred that the gasket 30 be substantially transparent.

As described above, the bow sight 10 is carried by a slide bar 14. The rear sight plate 12 has a vertical slot 32 therein that is configured such that its width 34 is smaller than the thickness 36 of the slide bar 14. As such, the end 38 of the slide bar 14 abuts the exterior face 40 of the rear sight plate 12. The rear sight plate 12 is clamped to the slide bar 14 by at least one bolt or screw 42 that threadably engages the slide bar 14. In some configurations, a washer 43 may be required to form the connection. This clamping configuration allows the plates 12, 20 to be vertically adjusted with respect to the slide bar 14 and thus the bow 16. In this manner, the bow sight 10 may be adjusted to fit into the viewing area of a wide variety of bows 16.

The slide bar 14 may be generally wedge-shaped in cross section such that it may be securely received in a wedge-shaped slot 44 in the receiving bracket 18. A bolt 46 is provided to securely connect the slide bar 14 to the bracket 18. The bolt 46 may abut the bar 14 or may pass through one of a series of holes 48 that are predrilled in the bar 14. In some embodiments, the holes 48 may be threaded such that the bolt 46 threadedly engages the bar 14.

After the bracket 18 has been attached to the bow 16 and the slide bar 14 connected thereto, the archer attaches the rear sight plate 12 to the slide bar 14 with the bolt 42. The archer then chooses a target at a known distance and places a nonpermanent mark, such as a marker or crayon mark, on the exterior of the rear sight plate 12. The archer then shoots at the target while sighting the target along this mark. The archer then checks the position of the arrow and readjusts the mark until the mark on the sight plate 12 corresponds with the known distance. The archer may continue this process until all of the desired distances are nonpermanently marked on the exterior surface of the rear sight plate 12.

The archer then removes the rear sight plate 12 from the slide bar 14 and places the sight dots 22 on the interior surface of the rear sight plate 12. The archer then aligns the sight dots 22 with the nonpermanent marks and places the gasket 30 and the front sight plate 20 on the rear sight plate 12. The screws 24 are then inserted and tightened such that the sight dots 22 and gasket 30 are clamped between the plates 12, 20. The archer may then remove the nonpermanent marks from the exterior surface 40 of the rear sight plate 12 and remount the plates 12, 20 on the slide bar 14.

Figure 4:
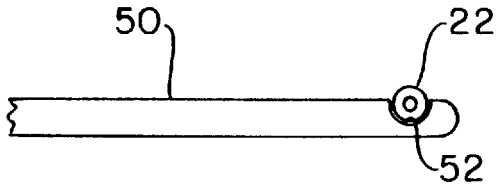
FIG. 4 is a view of one of the sight dots and a tool for adjusting the location of the sight dots.

The archer then retests the sight by shooting arrows at the known target distances. If adjustments are necessary, it is undesirable to have to completely disassemble the sight 10 to slightly move the sight dots 22. As such, a sight dot adjustment tool 50, depicted in FIG. 4, is provided. The adjustment tool 50 is relatively thin such that only one of the screws 24, or possibly two of the screws 24, need to be slightly loosened so that the adjustment tool 50 may slip between the gasket 30 and one of the plates 12, 20 to access the sight dots 22. The adjustment tool has a notch 52 that may engage the dots 22 to allow the archer to adjust them. Once the sight dots 22 are adjusted, the archer removes the adjustment tool 50 and retightens the screws 24. The archer then retests the sight 10 by shooting at the known target distances.

In a second embodiment of the present invention, the bow sight 10 is used with only the rear sight plate 12. In this embodiment, the sight dots 22 must be adhered to the rear sight plate 12 by means such as a releasable adhesive. In yet another embodiment of the present invention, the sight dots 22 are simply marked directly on the rear sight plate 12 with a marker or a crayon. In these embodiments, the use of only one sight plate 12 substantially reduces the overall weight of the bow sight 10.

While only a preferred embodiment and an alternative embodiment of the present invention are disclosed, it is to be clearly understood that the same are susceptible to numerous changes apparent to one skilled in the art. Therefore, the scope of the present invention is not to be limited to the details shown and described but is intended to include all changes and modifications which come within the scope of the appended claims. As such, it is to be understood that the present invention is not to be limited to the materials described herein. It should also be understood that the front 20 and rear 12 sight plates may be rearranged such that the front sight plate 20 may be used to form the connection with the slide bar 14.

As should now be apparent, the present invention not only teaches that a bow sight embodying the concepts of the present invention is capable of providing sight dots that are substantially surrounded by an unobstructed viewing area, but also that the other objects of the present invention are likewise accomplished.

What is claimed is:

1. A bow sight comprising:

a support;

a first substantially transparent sight plate carried by said support; and a first sight dot carried by said sight plate said sight dot being surrounded by unpatterned substantially transparent sight plate material that is unobstructed thereby forming an unobstructed viewing area through said sight plate around said sight dot.

2. A bow sight according to claim 1, wherein said first sight plate is adjustably mounted on said support.

3. A bow sight according to claim 1, further comprising a second sight dot carried by said sight plate, said second sight dot being spaced from and aligned with said first sight dot, said second sight dot being surrounded by an unobstructed viewing area.

4. A bow sight according to claim 3, further comprising a second sight plate carried by one of said first sight plate and said support.

5. A bow sight, comprising:

a support;

a first substantially transparent sight plate carried by said support;

a second substantially transparent sight plate adjustably carried by said first sight plate; and a sight dot carried by one of said sight plates such that said sight dot is surrounded by an unobstructed viewing area.

6. A bow sight according to claim 5, wherein said sight dot is clamped between said first and second sight plates.

7. A bow sight according to claim 6, further comprising a gasket between said sight plates and substantially disposed about the perimeter of said second sight plate.

8. A bow sight according to claim 7, wherein said gasket is substantially transparent.

9. A bow sight according to claim 6, wherein said sight plates are adjustably connected with a plurality of screws.

10. A bow sight according to claim 9, further comprising a second sight dot clamped between said first and second sight plates.

11. A bow sight according to claim 5, wherein said sight dot is marked directly on said first sight plate.

12. A bow sight according to claim 5, in combination with an adjustment tool for adjusting the position of said sight dot.

13. A bow sight, comprising:

a support;

a first substantially transparent sight plate adjustably mounted on said support;

a sight dot carried by said sight plate such that said sight dot is surrounded by an unobstructed viewing area;

said first sight plate defining a slot, said support abutting said sight plate over said slot; and at least one bolt extending through said slot and threadably engaging said support such that said bolt clamps said first sight plate between said bolt and said support.

14. A bow sight according to claim 13, further comprising a second sight plate carried by said first sight plate, said sight dot being clamped between said first and second sight plates.

15. A bow sight according to claim 14, further comprising a gasket between said sight plates and substantially disposed about the perimeter of said second sight plate.

16. A bow sight according to claim 15, wherein said gasket is substantially transparent.

17. A bow sight according to claim 14, wherein said sight plates are adjustably connected with a plurality of screws.

18. A bow sight according to claim 17, further comprising a second sight dot clamped between said first and second sight plates.

19. A bow sight according to claim 13, wherein said sight dot is marked directly on said first sight plate.

20. A bow sight comprising:

a support;

a first substantially transparent sight plate carried by said support;

a second substantially transparent sight plate carried by said first sight plate; and at least one sight dot clamped between said first and second sight plates such that said sight dot is surrounded by an unobstructed viewing area.

21. A bow sight according to claim 20, further comprising a gasket between said sight plates and substantially disposed about the perimeter of said second sight plate.

22. A bow sight according to claim 21, wherein said gasket is substantially transparent.

23. A bow sight according to claim 20, wherein said sight plates are adjustably connected with a plurality of screws.

24. A bow sight according to claim 20, wherein said first sight plate is adjustably mounted on said support.

25. A bow sight according to claim 24, wherein said first sight plate defines a slot, said support abutting said plate over said slot, said bow sight further comprising at least one bolt extending through said slot and threadedly engaging said support such that said bolt clamps said first sight plate between said bolt and said support.

26. A bow sight according to claim 20, in combination with an adjustment tool for adjusting the position of said sight dot.

* * * * *